US006444889B1

(12) United States Patent
Yahata

(10) Patent No.: US 6,444,889 B1
(45) Date of Patent: Sep. 3, 2002

(54) REGISTRATION APPARATUS AND METHOD FOR ELECTRONIC MUSICAL INSTRUMENTS

(75) Inventor: Takashi Yahata, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/998,977

(22) Filed: Oct. 31, 2001

(30) Foreign Application Priority Data

Nov. 6, 2000 (JP) ..... 2000-336848

(51) Int. Cl.[7] ..... G10H 1/36
(52) U.S. Cl. ..... 84/634; 84/666
(58) Field of Search ..... 84/610–614, 634–638, 84/650–652, 666–669, DIG. 12, DIG. 22, 622–625, 633, 659–661, 665

(56) References Cited

U.S. PATENT DOCUMENTS

| | | | | |
|---|---|---|---|---|
| 4,538,495 A | | 9/1985 | Sato | |
| 4,920,850 A | | 5/1990 | Matsumoto et al. | |
| 5,461,192 A | * | 10/1995 | Imaizumi | 84/634 |
| 6,031,175 A | * | 2/2000 | Tozuka | 84/610 |

* cited by examiner

*Primary Examiner*—Stanley J. Witkowski
(74) *Attorney, Agent, or Firm*—Frishauf, Holtz, Goodman & Chick, P.C.

(57) ABSTRACT

A registration apparatus for a musical instrument having a memory that has stored information representing set states of various parameters that specify respective types of rhythms to be accompanied automatically and respective types of musical sound generation. The set parameters are called and updated in a lump. By changing a type of calling, all the parameters can be called out immediately or only a parameter that specifies a type of accompaniment generation can be called out in synchronism with a predetermined timing of an accompaniment.

8 Claims, 13 Drawing Sheets

REGISTRATION APPARATUS AND METHOD FOR ELECTRONIC MUSICAL INSTRUMENTS

TECHNICAL FIELD

The present invention relates to registration apparatus and methods for electronic musical instruments.

BACKGROUND ART

In the past, electronic musical instruments have been known having a so called registration function that stores in a memory information collectively representing various set parameters that each specify a respective one of types of musical sound generation such as kinds of qualities and volumes of musical sounds to be generated, types of effects to be added to the musical sounds, and kinds of rhythms to be accompanied automatically, that selects an item of information that specifies a desired type of musical sound generation from among the plurality of items of information registered in the memory, and that forms a musical sound in accordance with various parameters that compose the selected item of information.

According to such electronic musical instrument, since a desired item of information is called from among the plurality of items of information registered in the memory in accordance with operation of a registration switch to thereby set the operational manners of the respective elements of the musical instrument, the type of musical sound generation can be switched to another easily during performance, which improves operability.

Since in the prior art electronic musical instruments the various set parameters are uniquely updated in accordance with the calling of an item of registered information, the parameters are changed at once, advantageously. However, when an item of registered information is called during automatic accompaniment and the type of the rhythm concerned is changed to another, this change abruptly occurs to thereby cause a feeling of musical disorder, undesirably.

In order to avoid such problem, the parameters should be changed so as not to cause such a feeling of musical disorder. This would, however, cause the advantage of changing the parameters instantaneously to be lost.

DISCLOSURE OF THE INVENTION

It is therefore an object of the present invention to provide a registration apparatus and method for an electronic musical instrument capable of changing parameters without instantaneously changing the parameters and also without causing any feeling of musical disorder.

In order to achieve the above objects, according to a first aspect of the present invention there is provided a registration apparatus for an electronic musical instrument, comprising:

a first memory having stored a plurality of different parameters specifying a type of musical sound generation and a type of accompaniment;

a second memory;

registration means for reading out from the first memory a plurality of different parameters specifying a type of musical sound generation and a type of accompaniment from the first memory in accordance with an instruction of registration and for registering in the second memory the read-out plurality of different parameters specifying a type of musical sound generation and a type of accompaniment;

automatic accompaniment means for reading out parameters that specify a type of accompaniment from among the plurality of different parameters stored in the first memory and for performing a corresponding automatic accompaniment;

call type specifying means for specifying one of a first and a second call type;

first registration transfer means, responsive to the call type specifying means specifying the first call type, for immediately transferring to the first memory the plurality of different parameters registered in the second memory irrespective of whether the accompaniment performed by the automatic accompaniment means is in progress; and second registration transfer means, responsive to the call type specifying means specifying the second call type during the accompaniment performed by the automatic accompaniment means, for transferring to the first memory the plurality of different parameters registered in the second memory when the accompaniment reaches a predetermined timing.

According to a second aspect of the present invention, there is also provided a registration apparatus for an electronic musical instrument, comprising:

a first memory having stored a plurality of different parameters specifying a type of musical sound generation and a type of accompaniment;

a second memory;

registration means for reading out from the first memory a plurality of different parameters specifying a type of musical sound generation and a type of accompaniment from the first memory in accordance with an instruction of registration and for registering in the second memory the read-out plurality of different parameters specifying a type of musical sound generation and a type of accompaniment;

automatic accompaniment means for reading out parameters that specify a type of accompaniment from among the plurality of different parameters stored in the first memory and for performing a corresponding automatic accompaniment;

call type specifying means for specifying one of a first and a second call type;

first registration transfer means, responsive to the call type specifying means specifying the first call type, for immediately transferring to the first memory the plurality of different parameters registered in the second memory irrespective of whether the accompaniment performed by the automatic accompaniment means is in progress; and second registration call means, responsive to the call type specifying means specifying the second call type, for immediately selecting the parameters that specify the type of musical sound generation from among the plurality of different parameters registered in the second memory and for transferring the selected parameters that specify the type of musical sound generation to the first memory irrespective of whether the accompaniment performed by the automatic accompaniment means is in progress, and for selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

According to a third aspect of the present invention, there is also provided a registration apparatus for an electronic musical instrument, comprising:

a first memory having stored a plurality of different parameters specifying a type of musical sound generation and a type of accompaniment;

a second memory;

registration means for reading out from the first memory a plurality of different parameters specifying a type of musical sound generation and a type of accompaniment from the first memory in accordance with an instruction of registration and for registering in the second memory the read-out plurality of different parameters specifying a type of musical sound generation and a type of accompaniment;

automatic accompaniment means for reading out parameters that specify a type of accompaniment from among the plurality of different parameters stored in the first memory and for performing a corresponding automatic accompaniment;

call type specifying means for specifying one of a first and a second call type;

first registration transfer means, responsive to the call type specifying means specifying the first call type during the accompaniment performed by the automatic accompaniment means, for transferring to the first memory the plurality of different parameters registered in the second memory when the accompaniment reaches a predetermined timing; and second registration call means, responsive to the call type specifying means specifying the second call type, for immediately selecting the parameters that specify the type of musical sound generation from among the plurality of different parameters registered in the second memory and for transferring the selected parameters that specify the type of musical sound generation to the first memory irrespective of whether the accompaniment performed by the automatic accompaniment means is in progress, and for selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

According to a fourth aspect of the present invention, there is also provided a registration method for an electronic musical instrument, comprising the steps of:

storing a plurality of different parameters specifying a type of musical sound generation and a type of accompaniment;

reading out from the first memory a plurality of different parameters specifying a type of musical sound generation and a type of accompaniment from the first memory in accordance with an instruction of registration and for registering in a second memory the read-out plurality of different parameters specifying a type of musical sound generation and a type of accompaniment;

reading out parameters that specify a type of accompaniment from among the plurality of different parameters stored in the first memory and for performing a corresponding automatic accompaniment;

specifying one of a first and a second call type;

responsive to the specifying step specifying the first call type, immediately transferring to the first memory the plurality of different parameters registered in the second memory irrespective of whether the accompaniment performed by the automatic accompaniment means is in progress; and responsive to the specifying step specifying the second call type during the accompaniment, transferring to the first memory the plurality of different parameters registered in the second memory when the accompaniment reaches a predetermined timing.

According to a fifth aspect of the present invention, there is also provided a registration method for an electronic musical instrument, comprising the steps of:

storing a plurality of different parameters specifying a type of musical sound generation and a type of accompaniment;

reading out from the first memory a plurality of different parameters specifying a type of musical sound generation and a type of accompaniment from the first memory in accordance with an instruction of registration and registering in a second memory the read-out plurality of different parameters specifying a type of musical sound generation and a type of accompaniment;

reading out parameters that specify a type of accompaniment from among the plurality of different parameters stored in the first memory and for performing a corresponding automatic accompaniment;

specifying one of a first and a second call type;

responsive to the specifying step specifying the first call type, immediately transferring to the first memory the plurality of different parameters registered in the second memory irrespective of whether the accompaniment is in progress; and responsive to the specifying step specifying the second call type, immediately selecting the parameters that specify the type of musical sound generation from among the plurality of different parameters registered in the second memory and transferring the selected parameters that specify the type of musical sound generation to the first memory irrespective of whether the accompaniment is in progress, and selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

According to a sixth aspect of the present invention, there is also provided a registration method for an electronic musical instrument, comprising the steps of:

storing a plurality of different parameters specifying a type of musical sound generation and a type of accompaniment;

reading out from the first memory a plurality of different parameters specifying a type of musical sound generation and a type of accompaniment from the first memory in accordance with an instruction of registration and registering in a second memory the read-out plurality of different parameters specifying a type of musical sound generation and a type of accompaniment;

reading out parameters that specify a type of accompaniment from among the plurality of different parameters stored in the first memory and for performing corresponding automatic accompaniment;

call type specifying means for specifying one of a first and a second call type;

responsive to the specifying step specifying the first call type during the accompaniment, transferring to the first memory the plurality of different parameters registered in the second memory when the accompaniment reaches a predetermined timing; and responsive to the specifying step specifying the second call type, immediately selecting the parameters that specify the type of musical sound generation from among the plurality of different parameters registered in the second memory and transferring the selected parameters that specify the type of musical sound generation to the first memory irrespective of whether the accompaniment is in progress, and selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

According to the above arrangement, the plurality of different parameters registered in the second memory are transferred to the first memory immediately in response to a type of calling being specified irrespective of whether the accompaniment is in progress or when the accompaniment reaches a predetermined timing. Furthermore, parameters specifying a type of musical sound generation among the plurality of different parameters registered in the second memory are transferred immediately to the first memory in response to the type of calling being specified and when the accompaniment reaches the predetermined timing only the parameter of specifying the type of accompaniment is transferred to the first memory. Therefore, the parameters can be changed or the occurrence of a feeling of musical disorder can be avoided which is due to abrupt changing of the parameters and/or abrupt switching of the type of a rhythm under accompaniment to another.

BRIEF DESCRIPTION OF THE DRAWINGS

The above and other objects and advantages of the invention will become more apparent and will be more readily appreciated from the following detailed description of the presently preferred embodiments of the invention taken in conjunction with the accompanying drawings, of which.

BEST MODE FOR CARRYING OUT THE INVENTION

One embodiment of the inventive electronic musical instrument will be described next with reference to the accompanying drawings.

A. Composition

Figure 1:
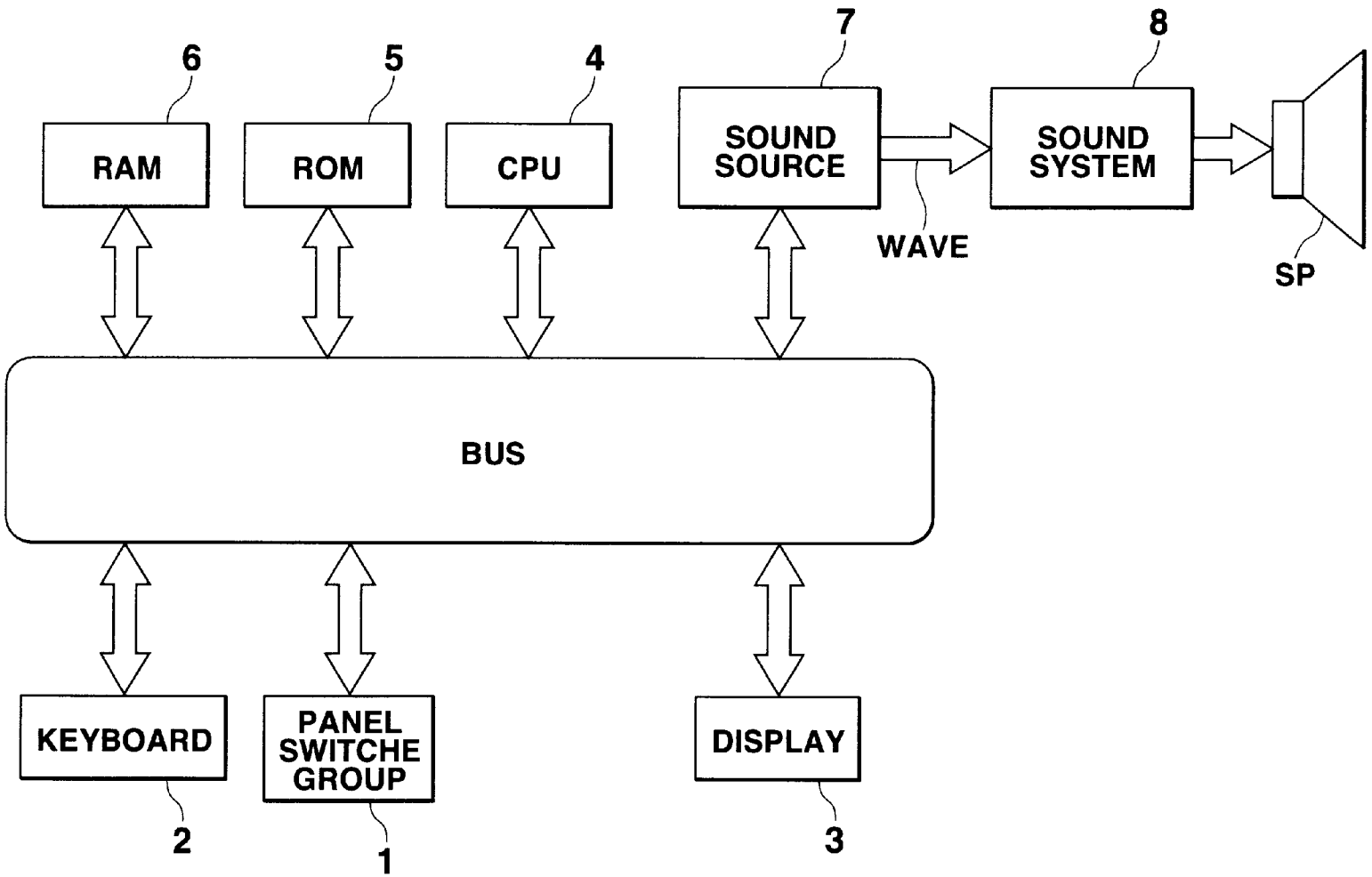
FIG. 1 is a block diagram of an electronic musical instrument as one embodiment of the present invention.

FIG. 1 is a block diagram of the electronic musical instrument as the embodiment of the present invention. In FIG. 1, reference numeral 1 denotes a group of panel switches disposed on a musical instrument panel, and generates a switch event signal in response to operation of a respective switch.

Although not shown, the panel switch group 1 includes a parameter select switch PSS that selects a parameter number representing a type of a parameter; a parameter input switch PIS that inputs the number of the parameter selected by the parameter select switch PSS, a start/stop switch SS that instructs the instrument to start/stop automatic accompaniment; a mode select switch MSS that selects a type of calling a registration; a registration switch RES that instructs the instrument to perform registration; and a registration call switch RCS that instructs the instrument to call a registration in a mode (registration calling type) selected by operation of mode select switch MSS. Processes performed in response to operation of those switches will be described sequentially in greater detail.

Reference numeral 2 denotes a keyboard that generates performance information that includes a key on/off signal, a key (or note) number KN and a key velocity corresponding to an operated key (performance). A display 3, composed of a LCD panel displays set states of the respective components of the musical instrument and its operational mode in accordance with a display control signal delivered from a CPU 4 of the instrument.

CPU 4 sets the respective operational states of the components of the instrument based on a switch event produced by operation of a relevant switch or various parameters stored in a current area CE of a RAM 6, produces a command (for example, a musical sound generating or muting command) depending on performance information delivered from the keyboard 2, and delivers the command along with parameter stored in RAM 6 to a sound source 7. A ROM 5 has stored various control programs to be loaded on CPU 4 and various rhythm patterns for use in automatic accompaniment.

Figure 2:
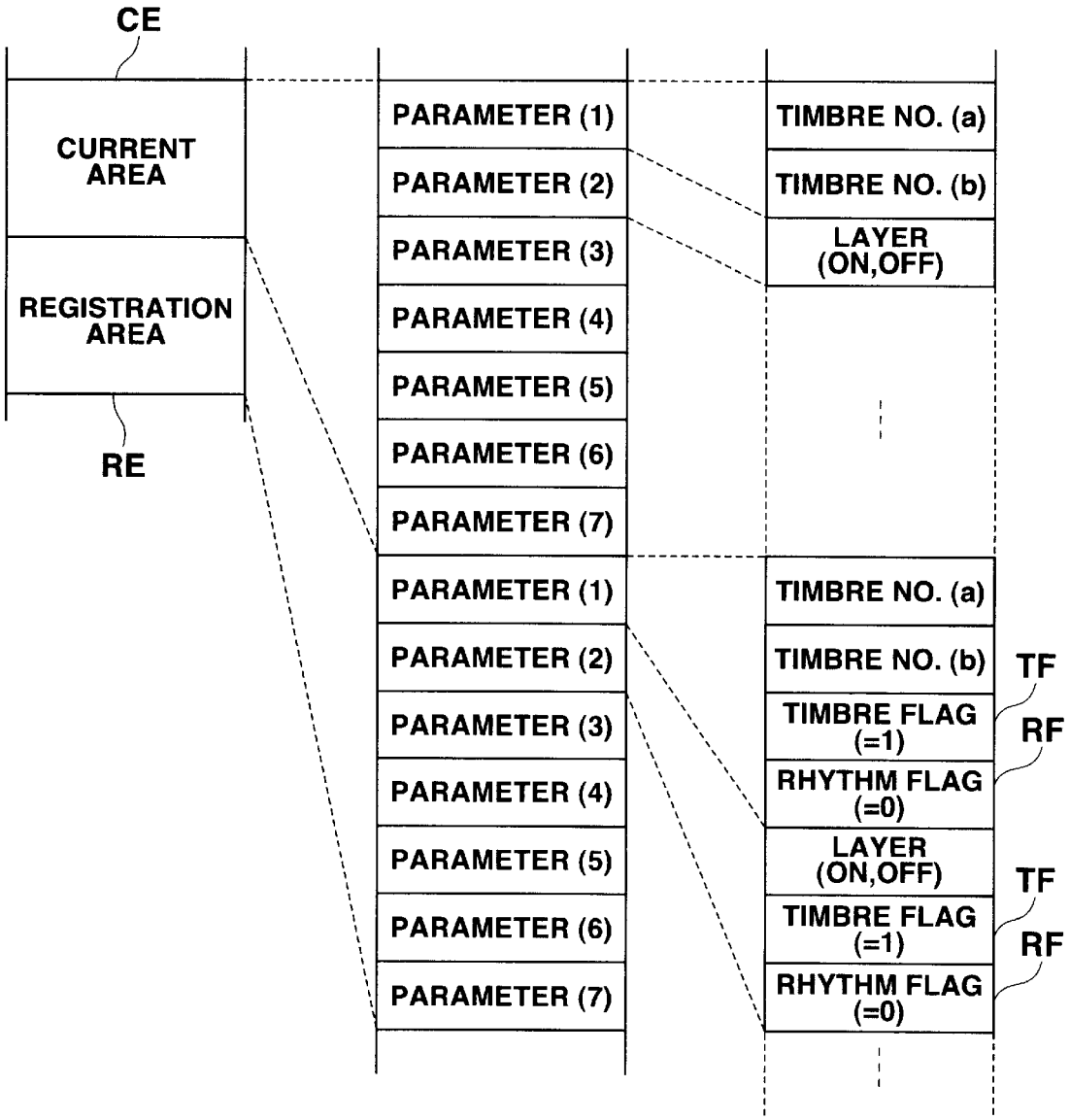
FIG. 2 illustrates the composition of a current area CE and a registration area RE in RAM 6.

RAM 6 has a work area that temporarily stores various register flag data, a current area CE and a registration area RE of FIG. 2.

Current area CE of RAM 6 temporarily stores parameters (1)–(7) input by operation of the parameter select switch PSS and parameter input switch PIS.

The parameters (1)–(7) are each read out from current area CE by CPU 4 and delivered to sound source 7.

As shown in FIG. 2, in the present embodiment parameter (1) includes two timbre numbers (a) and (b). Parameter (2) includes layer on/off data indicating whether musical sounds of the two timbre numbers (a) and (b) should be generated simultaneously as a layer sound. Although not shown in FIG. 2, parameter (3) includes split on/off data representing whether a selected one of different timbres allocated to two split key areas should be generated. Parameter (4) includes a transpose quantity representing how much a pitch about a depressed key should be transposed. Parameters (5), (6) and (7) include a rhythm number, a tempo value and a sound volume, respectively.

RAM registration area RE stores parameters (1)–(7) corresponding to those of current area CE. In response to registration switch RES being turned on, the respective parameters (1)–(7) in current area CE are registered as the corresponding parameters (1)–(7) in registration area RE. That is, the parameters (1)–(7) in registration area RE include "timbre numbers (a), (b)", "layer on/off data", "split on/off data", "transpose quantity", "rhythm number", "tempo value" and "sound volume", respectively.

For convenience of explanation, in the present embodiment only one registration area RE is illustrated as provided, but a plurality of such registration areas RE are actually provided each for registering a group of parameters.

Each of parameters (1)–(7) in registration area RE includes a timbre flag TF and a rhythm flag RF. Timbre flag TF represents whether a corresponding parameter relates to "timbre". In the present embodiment, "1" is set in the parameter (1)–(4) related to the "timbre" whereas "0" is set in the other parameters (5)–(7).

Rhythm flag RF represents whether a corresponding parameter relates to "rhythm". In the present embodiment "1" is set in the parameters (5)–(7) related to the "rhythm" whereas "0" is set in other parameters (1)–(4). In the present embodiment the values of flags TF and RF are preset at the factory.

Referring back to FIG. 1, sound source 7 has a built-in waveform data memory that has stored a plurality of different waveform data. In response to a parameter delivered by CPU 4, sound source 7 reads out corresponding waveform data therefrom and modifies the waveform data in accordance with performance information delivered by CPU 4 to generate a musical sound WAVE.

When sound source 7 receives an instruction to start automatic accompaniment from CPU 4, it reads out a corresponding rhythm pattern from ROM 5 based on the parameters (5)–(7), reproduces the pattern at a specified tempo, and performs automatic accompaniment of a rhythm sound concerned. A sound system 8 converts a musical sound output WAVE and a rhythm sound signal generated by sound source 7 to analog waveform signal, filters out unnecessary noise, amplifies a resulting sound signal and outputs a corresponding sound audibly via a speaker SP.

B. Operation

Operation of the embodiment will be described with reference to FIGS. 3–15.

(1) Operation of a Main Routine

Figure 3:
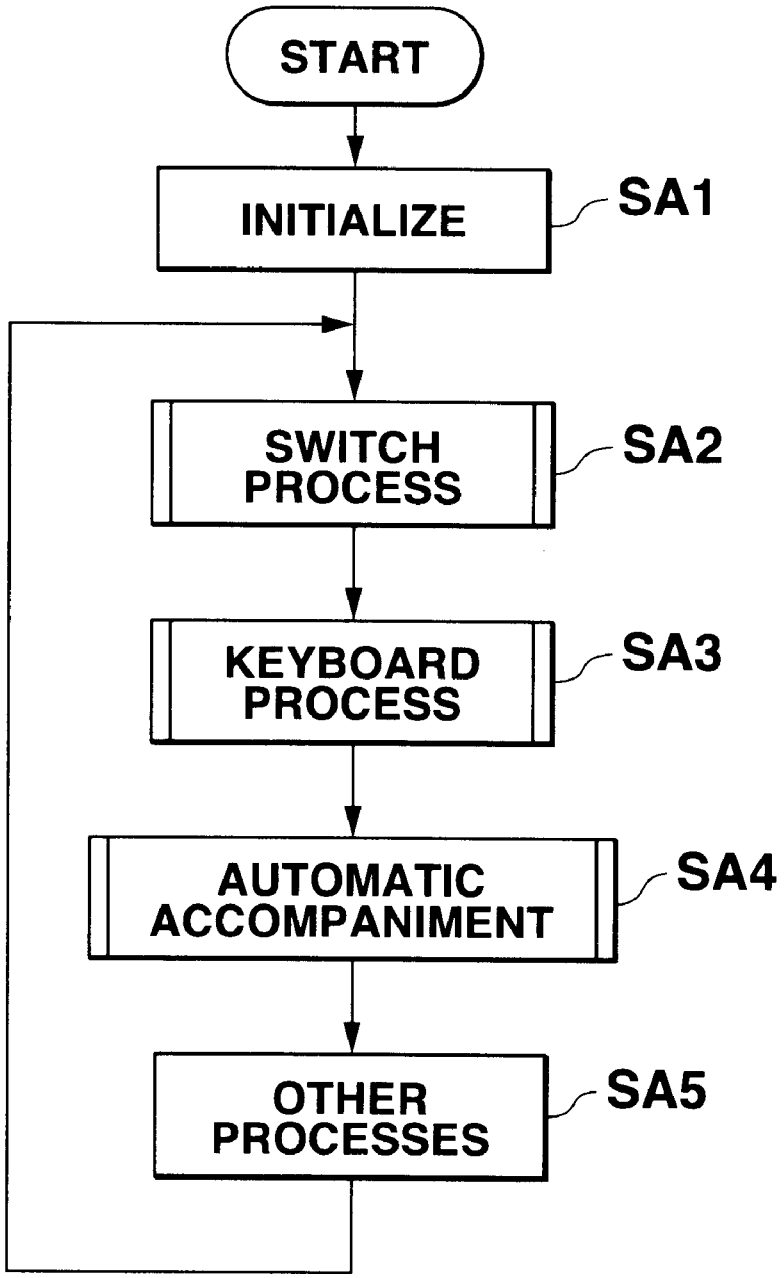
FIG. 3 is a flowchart of operation of a main routine.

When the power supply is turned on, CPU 4 reads out a predetermined control program from ROM 5, loads it thereon, and executes a main routine of FIG. 3. Then, CPU 4 passes its control to step SA1 to perform an initializing process including resetting various registers and flags stored in the work area of RAM 6 and setting required initial values in them. Also, in step SA1 CPU 4 instructs sound source 7 to initialize its various registers and flags. CPU 4 then passes its control to step SA2 to execute a switch process routine corresponding to a switch event produced by panel switch group 1.

In step SA3, CUP 4 executes a keyboard process routine that instructs sound source 7 to generate/mute a musical sound in response to operation of a key of keyboard 2. Then, in step SA4 when an instruction to start automatic accompaniment is given by operation of accompaniment start/stop switch SS, CPU 4 performs automatic accompaniment that reads out a relevant rhythm pattern from ROM 5 and that reproduces it. Subsequently, in step SA5 CPU 4 performs another process such as addition of effects. Then, CPU 4 repeats steps SA2–SA 6 until the power supply is turned off.

(2) Operation of Switch Process Routine

Referring to FIGS. 4–10, respective operations of "parameter select switch process routine", "parameter input switch process routine", "start/stop process routine", "mode select switch process routine", "registration switch process routine", and "registration call switch process routine" that compose a switch process routine will be described sequentially next.

(2-a) Operation of Parameter Select Switch Process Routine

Figure 4:
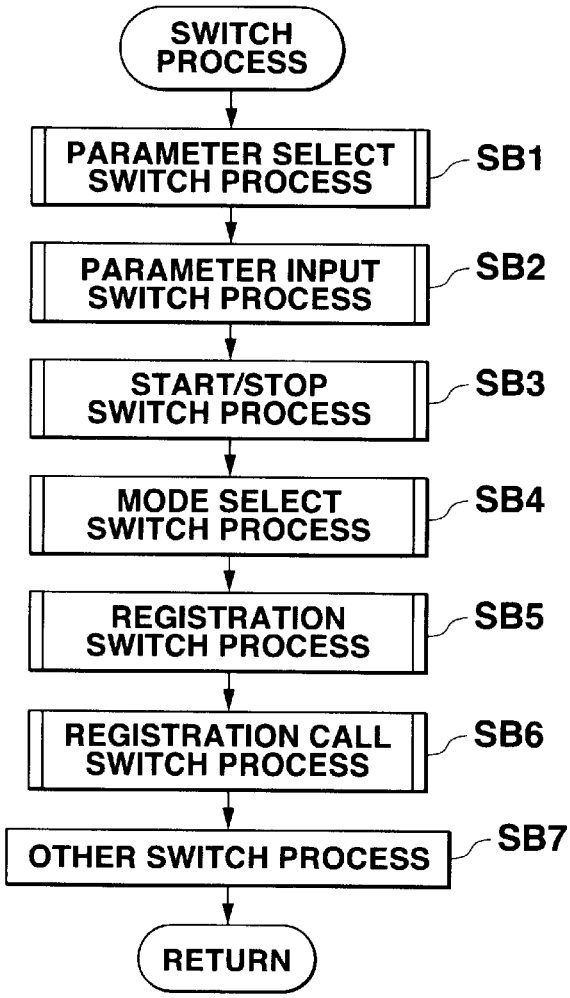
FIG. 4 is a flowchart of operation of a switch process routine.
Figure 5:
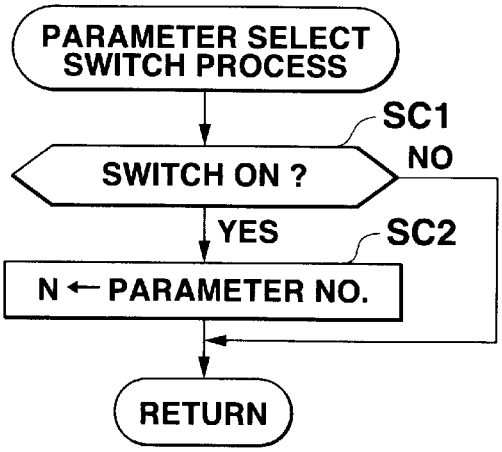
FIG. 5 is a flowchart of operation of a parameter select switch process routine.

When the switch process routine is executed through main routine step SA2 (FIG. 3), CPU 4 executes the parameter select switch process routine through SB1 of FIG. 4, passes its control to step SC1 of FIG. 5 to determine whether parameter select switch PSS was switched on.

Although not shown, parameter select switch PSS comprises a key switch that increments/decrements a parameter number displayed on display 3.

Unless parameter select switch PSS is turned on, a result of the determination becomes "NO" in step SCI, and this routine is then terminated. When PSS is turned on, a result of the determination becomes "YES" and the control passes to step SC2 to store in register N a parameter number selected by operation of parameter select switch PSS. A value to be stored in register N will be described as a parameter number N hereinafter.

(2-b) Operation of Parameter Input Switch Process Routine

Figure 6:
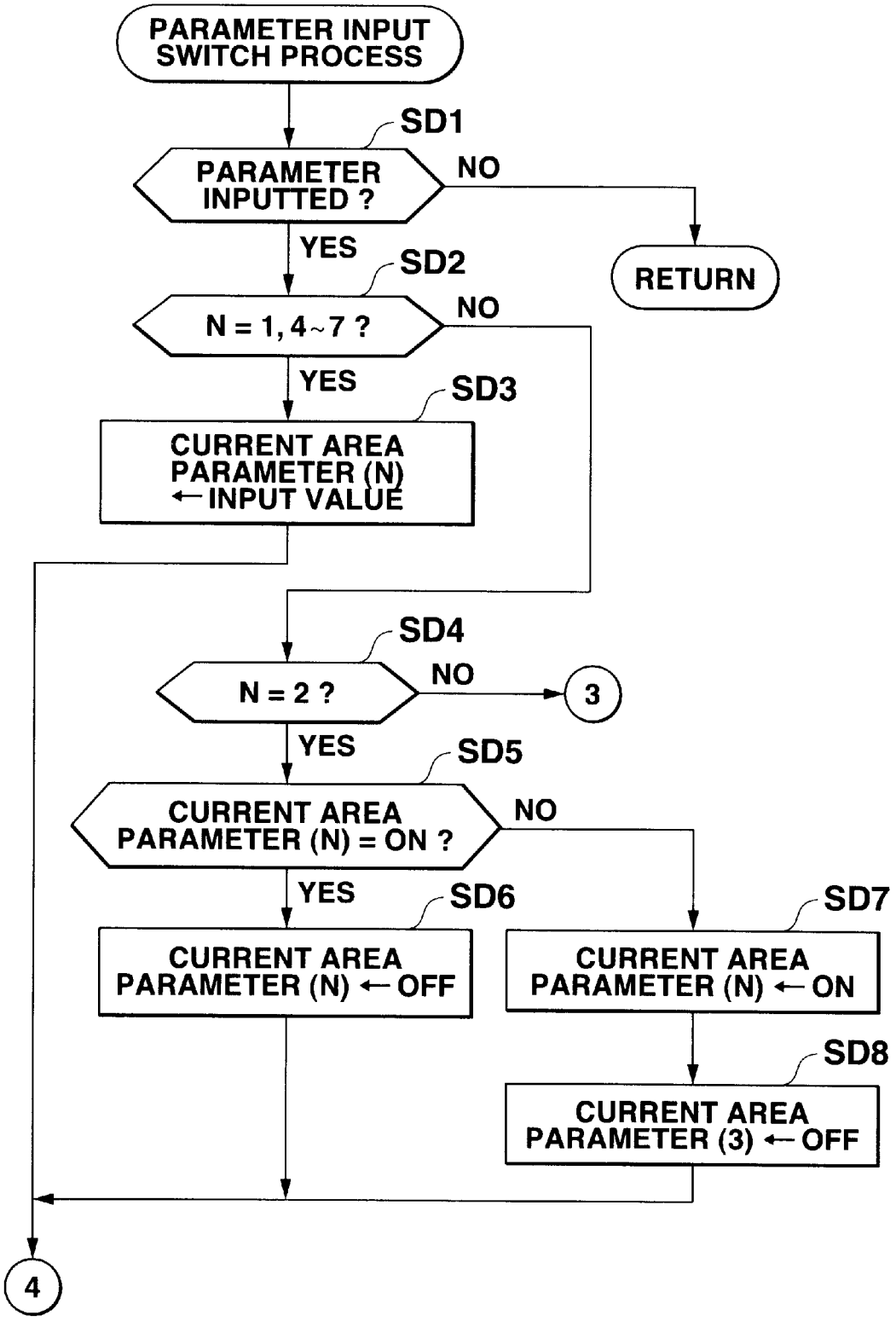
FIG. 6 is a flowchart of operation of a part of a parameter input switch process routine.

When the parameter select switch process has been terminated, CPU 4 executes the parameter input switch process routine through step SB2 (FIG. 4) to thereby pass the control to step SD1 of FIG. 6 to determine whether parameter input switch PIS that comprises numeral input keys or an alternate numerical input (for example, a continuously changing analog value input) key switch has been operated. If it is not, a result of the determination becomes "NO" to thereby terminate this routine.

If switch PIS is switched on, a result of the determination becomes "YES" to thereby pass the control to step SD2 to perform an input process corresponding to the parameter number N selected by switch PSS, which will be described sequentially.

(2-b-1) When Parameter Number N is "1" or any one of "4–7"

In this case, a result of the determination in step SD2 becomes "YES", and the control then passes to step SD3 to store numerical data input by operating the numeral keys of switch PIS as a parameter (N) in current area CE (FIG. 2) of RAM 6 to thereby terminate this routine. As described above, when parameter number N is "1" or any one of "4–7", or when any one of "timbre number (N=1)", "transpose quantity (N=4)", "rhythm number (N=5)", "tempo (N=6)" and "sound volume (N=7)" is selected, a numerical value input by operating parameter input switch PIS is registered as a parameter in current area CE.

(2-b-2) When Parameter Number N is "2"

In this case, the control passes through step SD2 to step SD4 in which a result of the determination becomes "YES". The control then passes to step SD5 to determine whether layer on/off data stored as parameter (2) in current area CE is set to "ON". If it is, a result of the determination becomes "YES". Then the control passes to step SD6 to set the layer on/off data of parameter (2) to "OFF" and then terminates this routine. When the layer on/off data is set to "OFF", the result of the determination in step SD5 becomes "NO" and then the control passes to step SD7 to set layer on/off CE data (parameter (2)) to "ON" in the current area. Thus, step SD8 sets the split on/off data (parameter (3)) stored in current area CE to "OFF" and then this routine is terminated.

(2-b-3) When Parameter Number N is "3"

Figure 7:
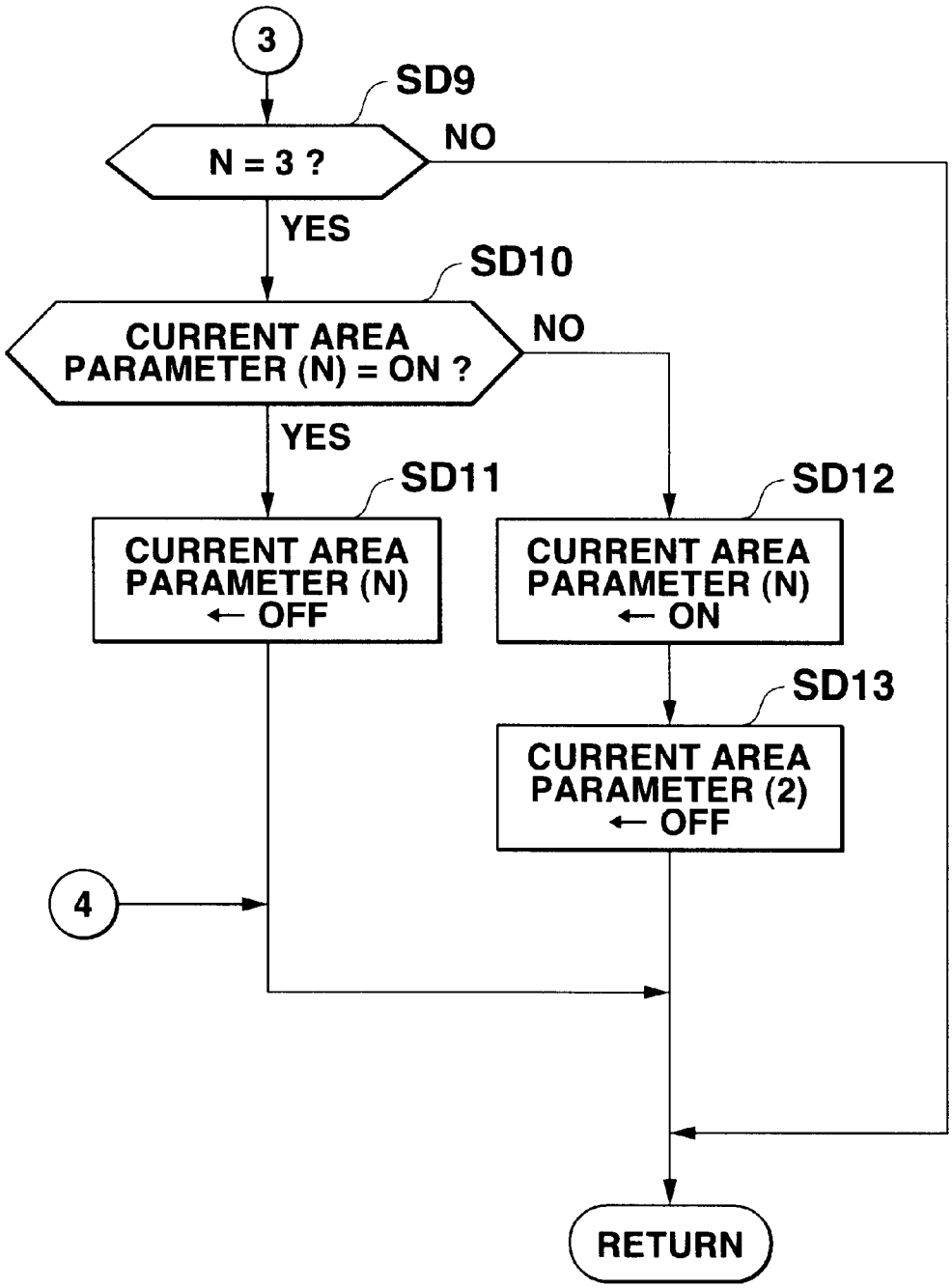
FIG. 7 is a flowchart of operation of the remaining part of the parameter input switch process routine.

In this case, the control passes through steps SD2 and SD4 to step SD9 of FIG. 7 in which a result of the determination becomes "YES". The control then passes to step SD10 to determine whether the split on/off data CE (parameter (3)) stored in current area CE is set to "ON". If it is, a result of the determination becomes "YES". The control then passesto step SD11 to set the layer on/off data stored as parameter (3) to "OFF" and then to terminate the routine.

When the split on/off data is set to "OFF", the result of the determination in step SD1 becomes "NO". The control then passes to step SD12 to set the split on/off data (parameter (3)) to "ON". Therefore, step SD13 then sets the layer on/off data (parameter (2)) stored in current area CE to "OFF", and then terminates the routine.

(2-c) Operation of Start/Stop Switch Process Routine

Figure 8:
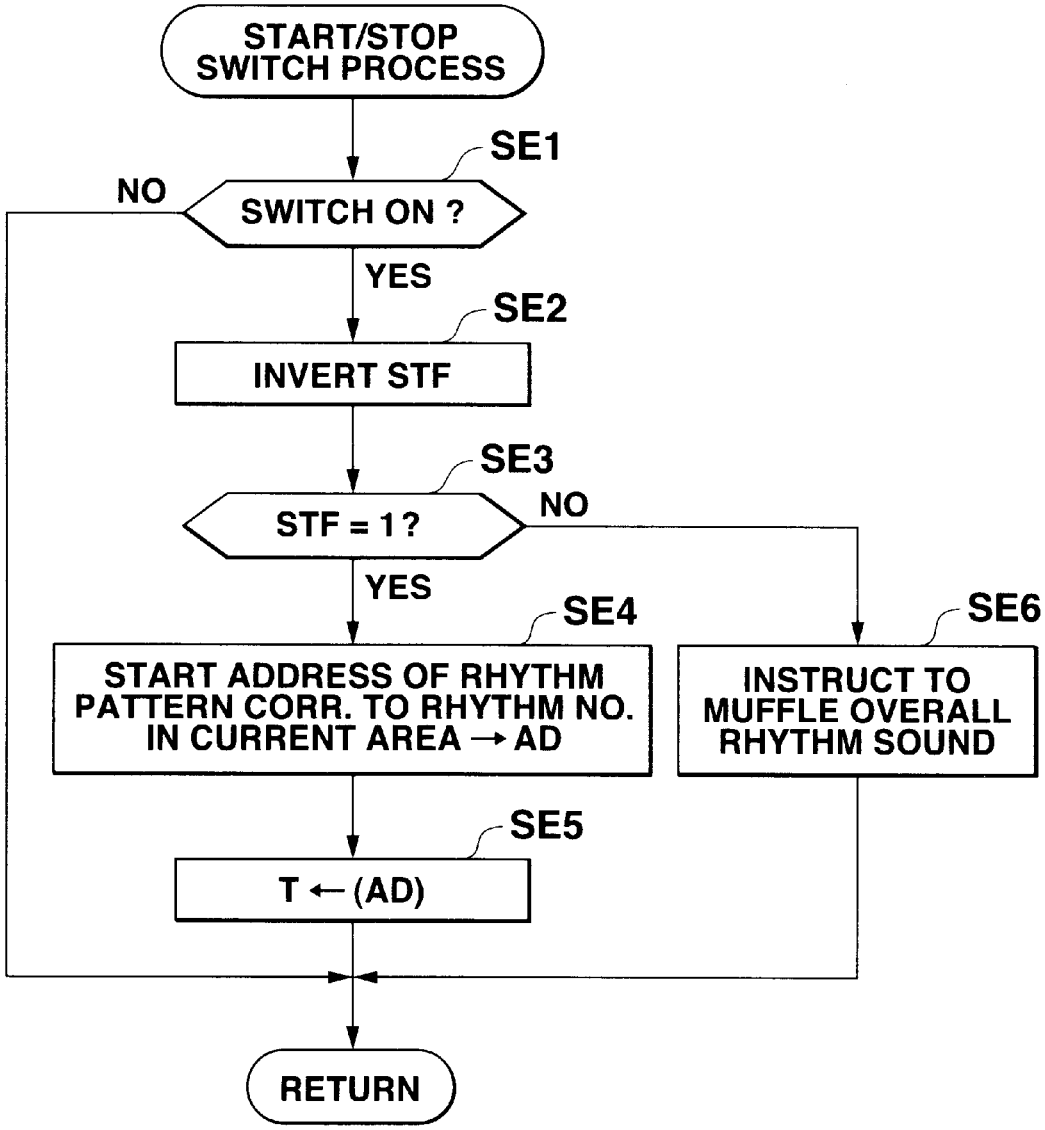
FIG. 8 is a flowchart of operation of a start/stop switch process routine.

When the parameter input switch process is terminated, CPU 4 executes a start/stop switch process routine through step SD3 (FIG. 4) and then passes its control to step SE1 of FIG. 8. Step SE1 determines whether start/stop switch SS has been switched on. If it is not, a result of the determination becomes "NO" and the routine is then terminated.

When start/stop switch SS has been switched on, the result of the determination becomes "YES". The control then passes to step SE2 to invert start flag STF stored in register STF. Start flag STF "1" represents a start of automatic accompaniment whereas "0" represents a stop of automatic accompaniment. That is, start/stop switch SS is a so-called toggle switch that sets a flag so as to alternately represent the start and stop of automatic accompaniment each time switch SS is operated. Step SE3 determines whether the inverted start flag STF is "1" or has specified the start of the automatic accompaniment.

When it is, the result of the determination becomes "YES". The control then passes to step SE4 to store in register AD a start address of a rhythm pattern corresponding to a rhythm number (parameter (5)) stored in current area CE. Then, step SE5 reads timing data of a start of a rhythm pattern from ROM 6 by referring to the start address stored in register AD, and stores it in register T. Then, the routine is terminated.

In contrast, when start flag STF is "0", the result of the determination in step SE3 becomes "NO". The control then passes to step SE6 to instruct the sound source 7 to mute the whole rhythm sound.

(2-d) Operation of Mode Select Switch Process Routine

Figure 9:
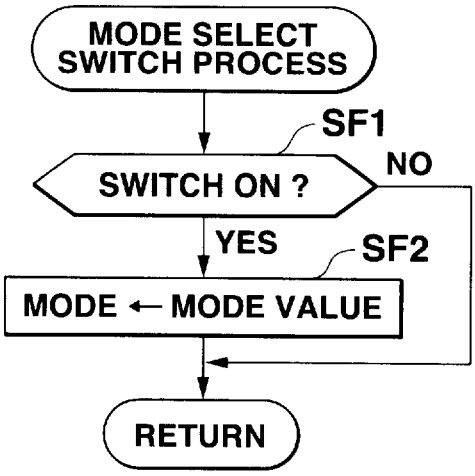
FIG. 9 is a flowchart of operation of a mode select switch process routine.

When the start/stop switch process is terminated, CPU 4 executes a mode select switch process routine through step SB4 (FIG. 4) and then passes its control to step SF1 of FIG. 9 to determine whether mode selects switch MSS is switched on.

If it is not, a result of the determination becomes "NO" and then the routine is terminated directly. If mode select switch MSS is switched on, the result of the determination becomes "YES". The control then passes to step SF2 to store in register MODE a mode value set in response to mode selects switch MSS being switched on and then terminate the routine.

The mode value (hereinafter referred to as a mode value MODE) to be stored in register MODE specifies a type of calling a registration and takes any one of "0", "1" and "2".

Mode value MODE "0" specifies a type in which all the parameters (1)–(7) in registration area RE should be immediately read out at a timing when registration call switch RCS is switched on and stored in current area CE.

Mode value MODE "1" specifies a type in which a registration should be called when automatic accompaniment is in progress. That is, the mode value MODE "1" specifies a type in which all parameters (1)–(7) in registration area RE should be read out at a timing when a head of the next measure appears after registration call switch RCS is switched on during automatic accompaniment, and then stored in current area CE.

Mode value MODE "2" specifies a type in which a timbre parameter should be read out from registration area RE at a timing when registration call switch RCS is switched on and that a rhythm parameter should be read out from registration area RE at a timing when a head of the next measure appears after registration call switch RCS is switched on.

(2-e) Operation of Registration Switch Process Routine

When the mode select switch process routine is terminated, CPU 4 executes a registration switch process routine through step SB5 (FIG. 4), and then passes its control to step SG1 of FIG. 9. Step SG1 determines whether registration switch RES is switched on. If it is not, a result of the determination becomes "NO" and then the routine is terminated.

When switch RES is switched on, the result of the determination becomes "YES". The control then passes to step SG2 to store an initial value "1" in the register n. Then, step SG3 reads out a parameter (n) in current area CE corresponding to the value in the register n, and registers it as a parameter (n) in registration area RE.

Step SG4 increments the value in register n. Then step SF 5 determines whether the incremented value in register n has exceeded "7", or whether all the parameters in current area CE have been registered in registration area RE.

Steps SG3–SG5 are iterated until all the parameters are registered, at which time a result of the determination in step SG5 becomes "YES". Then the routine is terminated.

(2-f) Operation of Registration Call Switch Process Routine

Figure 10:
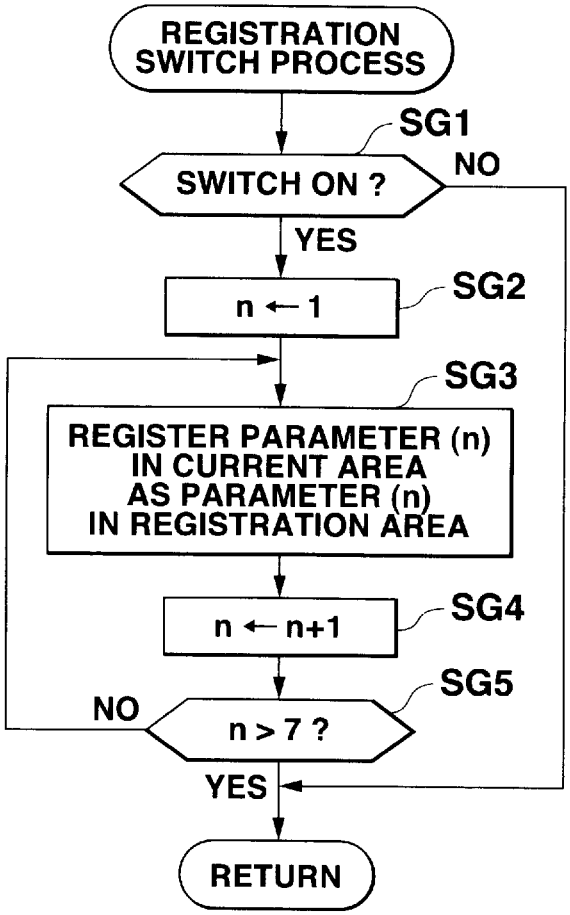
FIG. 10 is a flowchart of operation of a registration switch process routine.
Figure 11:
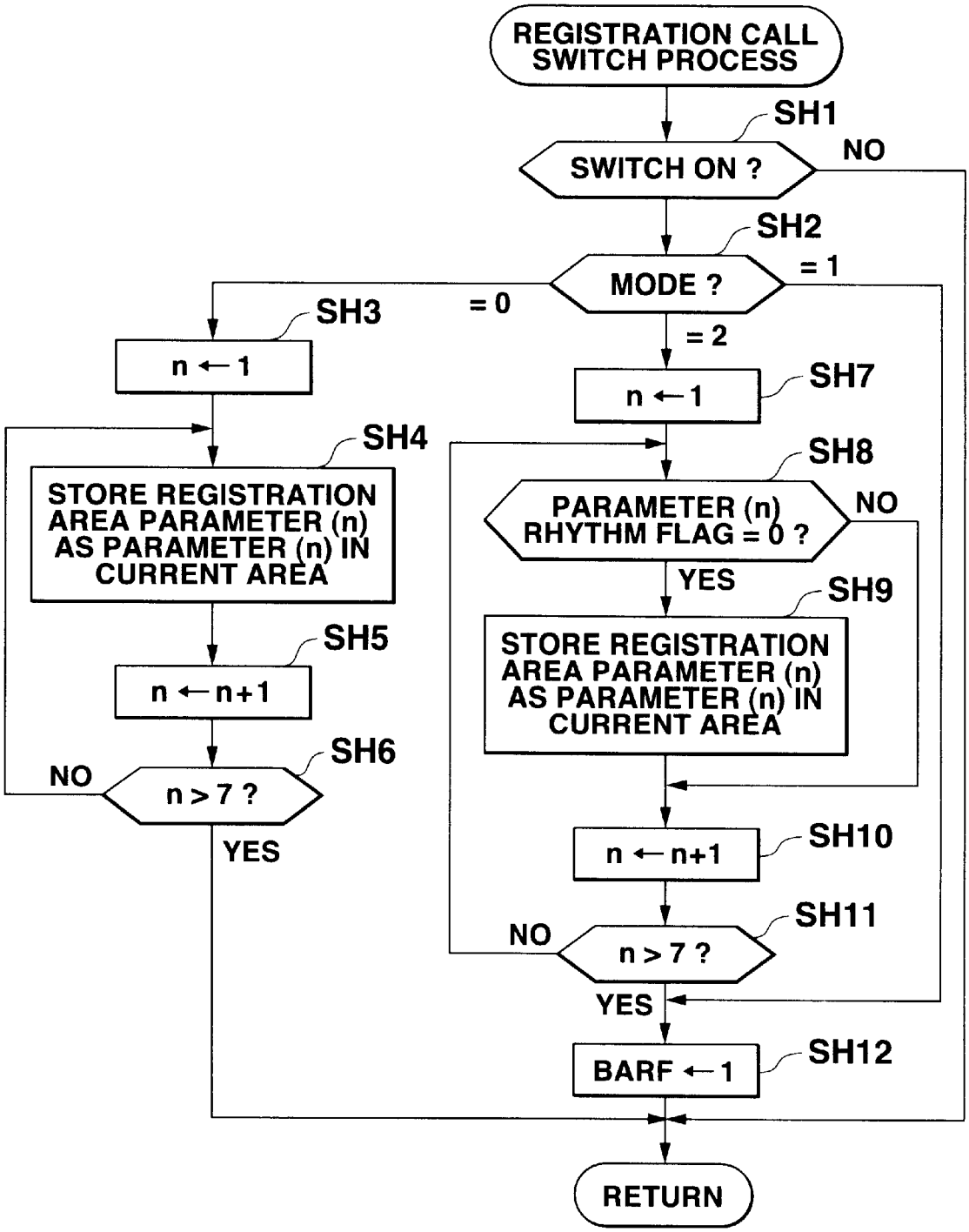
FIG. 11 is a flowchart of operation of a registration call switch process routine.

When the registration switch process routine is terminated, CPU 4 executes a registration call switch process routine through step SB6 (FIG. 4) and passes its control to step SH1 of FIG. 10. Step SH1 determines whether registration call switch RCS is switched on. If it is not, a result of the determination becomes "NO" and the routine is then terminated.

If switch RCS is switched on, the result of the determination becomes "YES". The control then passes to step SH2 to determine a mode value MODE set in the mode select switch process (FIG. 9). Then, step SH3 and subsequent steps each execute a process depending on the determined mode value MODE as follows.

(2-f-1) When Mode Value MODE is "0"

When mode value MODE is set to "0", the control passes to step SH3 to store an initial value "1" in register n. Then, step SH4 reads out a corresponding parameter (n) in registration area RE, and stores it as a parameter (n) in the current area CE. Then, step SH5 increments the value in register n by one. Then, step SH6 determines whether the incremented value of register n has exceeded "7", or whether the registration call has been terminated.

If it has not, a result of the determination in step SH6 becomes "NO". Steps SH4 and SH5 are then iterated until the registration call is terminated, at which time the result of the determination in step SH6 becomes "YES". The routine is then terminated.

As described above, when the mode value MODE is set to "0", all the parameters (1)–(7) are read out from registration area RE to current area CE immediately in response to the on operation of registration call switch RCS.

(2-f-1) When Mode Value MODE is "1"

When mode value MODE is set to "1", the control passes to step SH12 to set flag BARF to "1". Then the routine is terminated.

When the mode value MODE and flag BARF are set to "1" each, all the parameters (1)–(7) are called from registration area RE to the current area CE at a timing when the head of the next measure appears after registration call switch RCS is switched on in an automatic accompaniment process to be described later in more detail.

(2-f-3) When Mode Value MODE is "2"

When mode value MODE is set to "2", the control passes to step SH7 to store an initial value "1" in register (n). Then, step SH8 determines whether a rhythm flag RF included in a parameter (n) in registration area RE corresponding to the value of register n is "0", or whether a parameter n in registration area RE is a timbre parameter.

If it is, a result of the determination becomes "YES". The control then passes to step SH9 to read out a parameter (n) in registration area RE corresponding to the value of the register n, and stores it as a parameter (n) in the current area CE. If it is a rhythm parameter, the result of the determination becomes "NO".

Then, step SH10 increments the value of register n by one. Then, step SH11 determines whether the incremented value of register n has exceeded "7", or whether the registration call has been terminated.

If it has not, a result of the determination becomes "NO", and steps SH8–SH10 are iterated until the registration call is terminated at which time the control passes to step SH12 to set "1" in flag BARF. The routine is then terminated.

As described above, when the mode value MODE is set to "2", only the timbre parameter is called from registration area RE in response to the registration switch RCS being switched on, and then stored in current area CE. Then flag BARF is set to "1".

When mode value MODE and flag BARF are set to "2" and "1", respectively, in the automatic accompaniment process only the rhythm parameter is called from registration area RE to current area CE at a timing when the head of the next measure appears after the registration call switch RCE is switched on.

(3) Operation of Keyboard Process Routine

Figure 12:
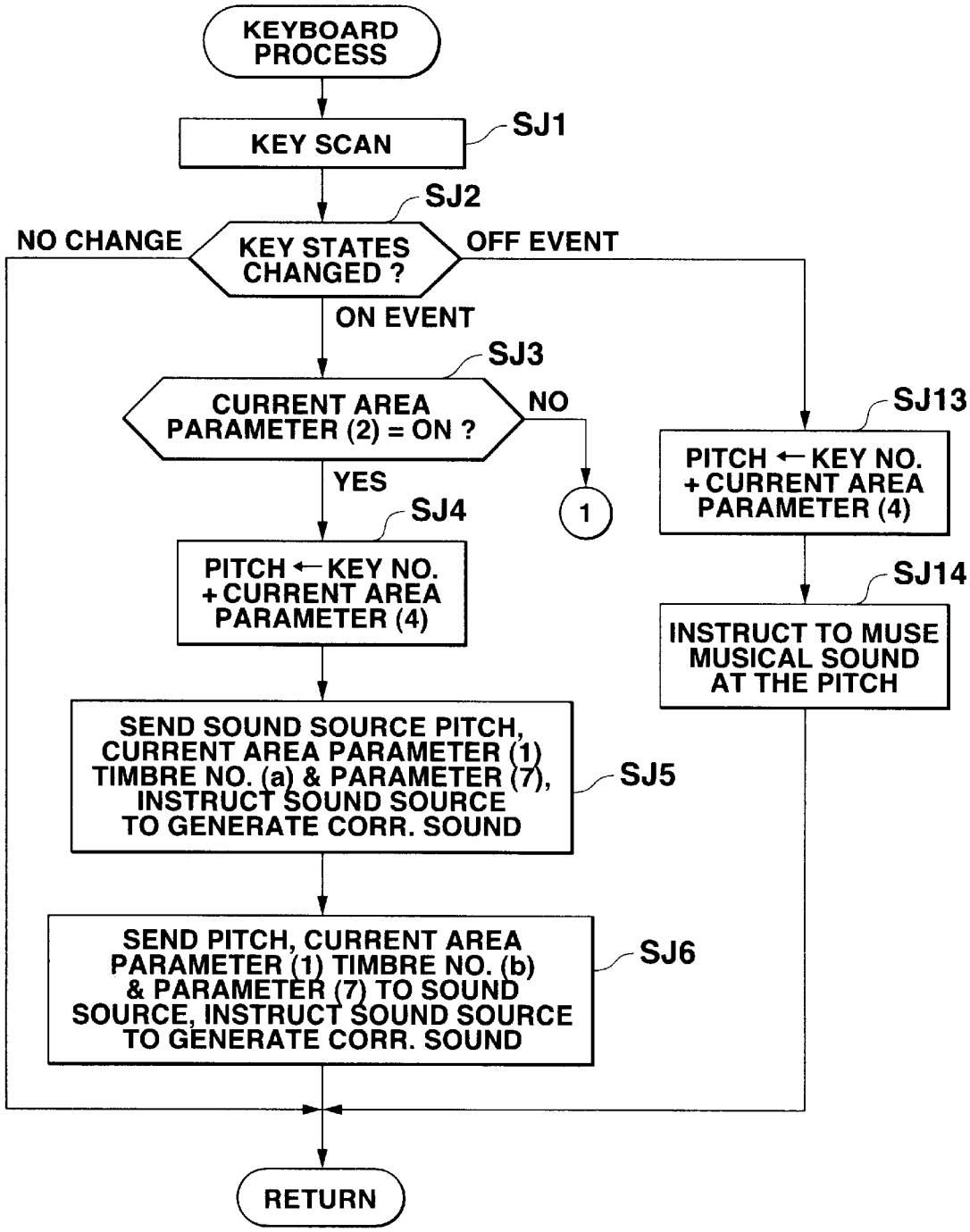
FIG. 12 is a flowchart of operation of a part of a keyboard process routine.
Figure 13:
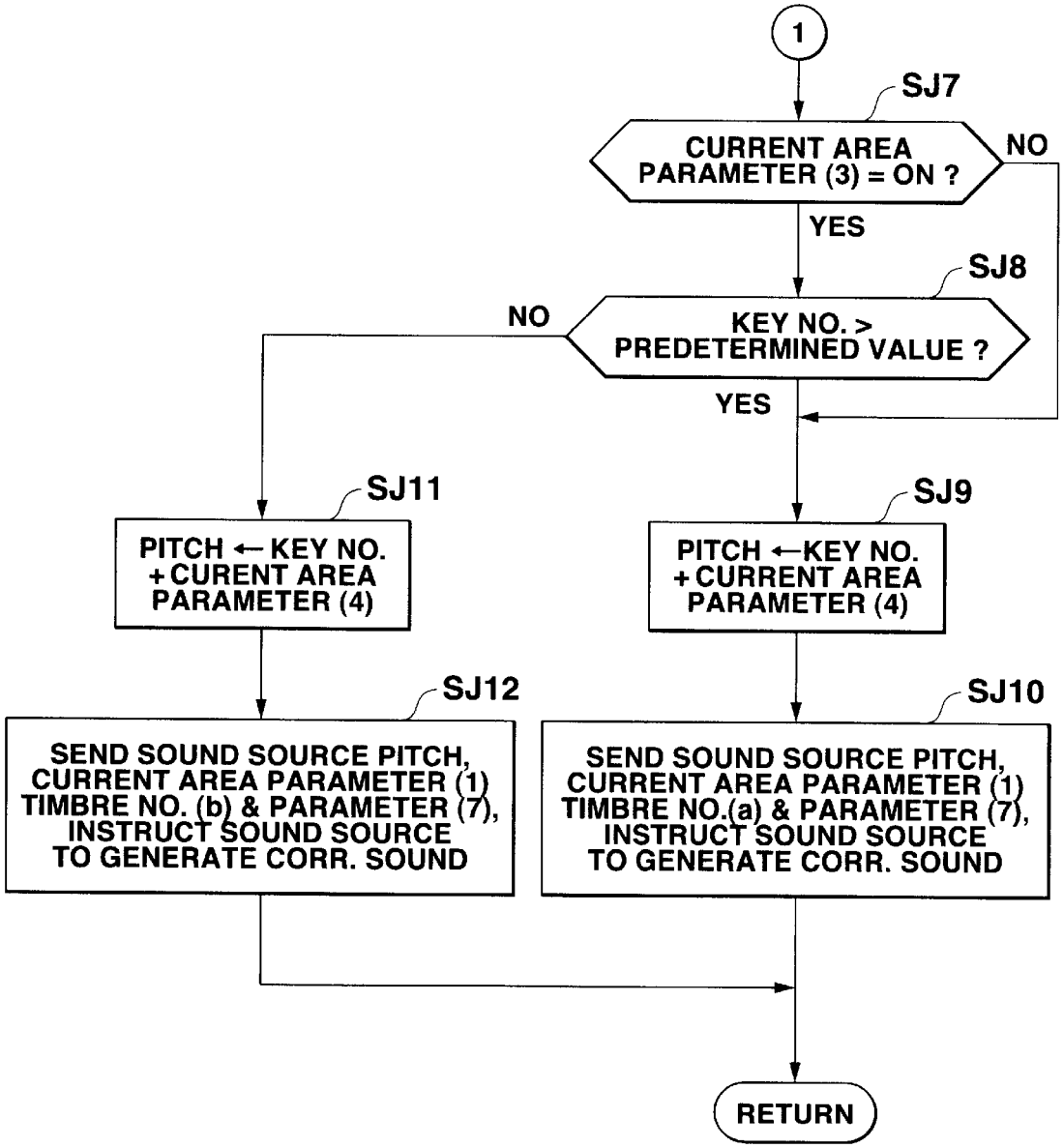
FIG. 13 is a flowchart of operation of the remaining part of the keyboard process routine.

Referring to FIGS. 12 and 13, operation of the keyboard process routine will be described. When the keyboard process routine is executed through step SA3 (FIG. 3) of the main routine, CPU 4 passes its control to step SJ1 of FIG. 12 to scan the keys of the keyboard 2. Then, step SJ2 determines whether there is a change in the key states, or whether any key is depressed or released based on a result of scanning of the keys in step SJ1.

When no keys are operated or no key events occur, the routine is then terminated immediately without performing any other processes. If an on event occurs due to the depression of a key, steps SJ3–SJ12 are executed. When an off event due to a release of a key occurs, steps SJ3 and SJ12 are executed. Processes corresponding to the occurrence of the respective events will be described next.

(3-a) When an On Event Occurs

When an on event occurs, CPU 4 passes its control to step SJ3 to instruct sound source 7 to generate a musical sound in a manner depending on the set parameters in the current area CE. Respective manners of generating musical sounds depending on the set parameters will be described next.

(3-a-1) Layer Musical Sound

When musical sounds having timbre numbers (a) and (b) are generated as a layer sound or simultaneously, a parameter (2) in current area CE is set to "ON". Thus, a result of the determination in step SJ3 becomes "YES". The control then passes to step SJ4 to read out a transpose quantity stored as a parameter (4) in the current area CE, and adds it to a key number KN of the depressed key to produce pitch data PD.

Then, step SJ5 sends sound source 7 pitch data PD, timbre number (a) stored as parameter (1) in the current area CE and a sound volume stored as parameter (7) and instructs the sound source to generate a corresponding musical sound. Then, like step SJ5 step SJ6 sends sound source 7 pitch data PD, timbre number (b) stored as parameter (1) in current area CE and a sound volume stored as parameter (7) and instructs the sound source to generate a corresponding musical sound.

Thus, sound source 7 generates musical sounds of timbre numbers (a) and (b) as a layer sound or simultaneously at a pitch corresponding to pitch data PD in a specified sound volume.

(3-a-2) Split Sounds

When two different timbres allocated to corresponding split key areas of the keyboard with a predetermined key as a boundary are generated separately, parameters (2) and (3) in current area CE are set to "OFF" and "ON", respectively. Thus, the control passes through step SJ3 to step SJ7 of FIG. 13 where a result of the determination becomes "YES".

Then, step SJ8 determines whether the key number KN of the depressed key has exceeded a predetermined number, or on which side of the split keyboard areas (higher/lower sound areas) the pressed key is. For example, when the depressed key is on the side of the higher sound area, the result of the determination in step SJ8 becomes "YES". Thus, the control then passes to step SJ9 to read out a transpose quantity stored as a parameter (4) in the current area CE, and to add this to the key number KN of the depressed key to produce pitch data PD.

Then, when the control passes to step SJ10, CPU 4 sends sound source 7 pitch data PD, timbre number (a) and volume stored as parameters (1) and (7), respectively, in current area CE, and instructs the sound source to generate a corresponding sound. In response to this instruction, sound source 7 generates a musical sound having timbre number (a) at a pitch corresponding to pitch data PD in a specified volume.

When the depressed key is on the side of the lower sound area, CPU 4 executes steps SJ11 and SJ12 to cause sound source 7 to generate a musical sound having a timbre number (b) at a pitch corresponding to pitch data PD in a specified volume, as in the case of steps SJ9 and SJ10.

(3-a-3) Ordinary Sound Generation

In the case of ordinary musical sound generation, parameters (2) and (3) in RAM current area CE are both set to "OFF". Thus, results of the determination in steps SJ3 and SJ7 both become "NO". Then, steps SJ9 and SJ10 cause sound source 7 to generate a musical sound having a timbre number (a) at a pitch corresponding to pitch data PD in a specified volume.

(3-b) When an Off Event Occurs

When an off event occurs in response to a key releasing operation, CPU 4 passes its control through step SJ2 to step SJ13 to read out a transpose quantity stored as a parameter (4) in the current area CE, and then to add it to the key number KN of the released key to produce pitch data PD. Then, step SH14 instructs sound source 7 to mute the musical sound corresponding to pitch data PD.

(4) Operation of Automatic Accompaniment Process Routine

Figure 14:
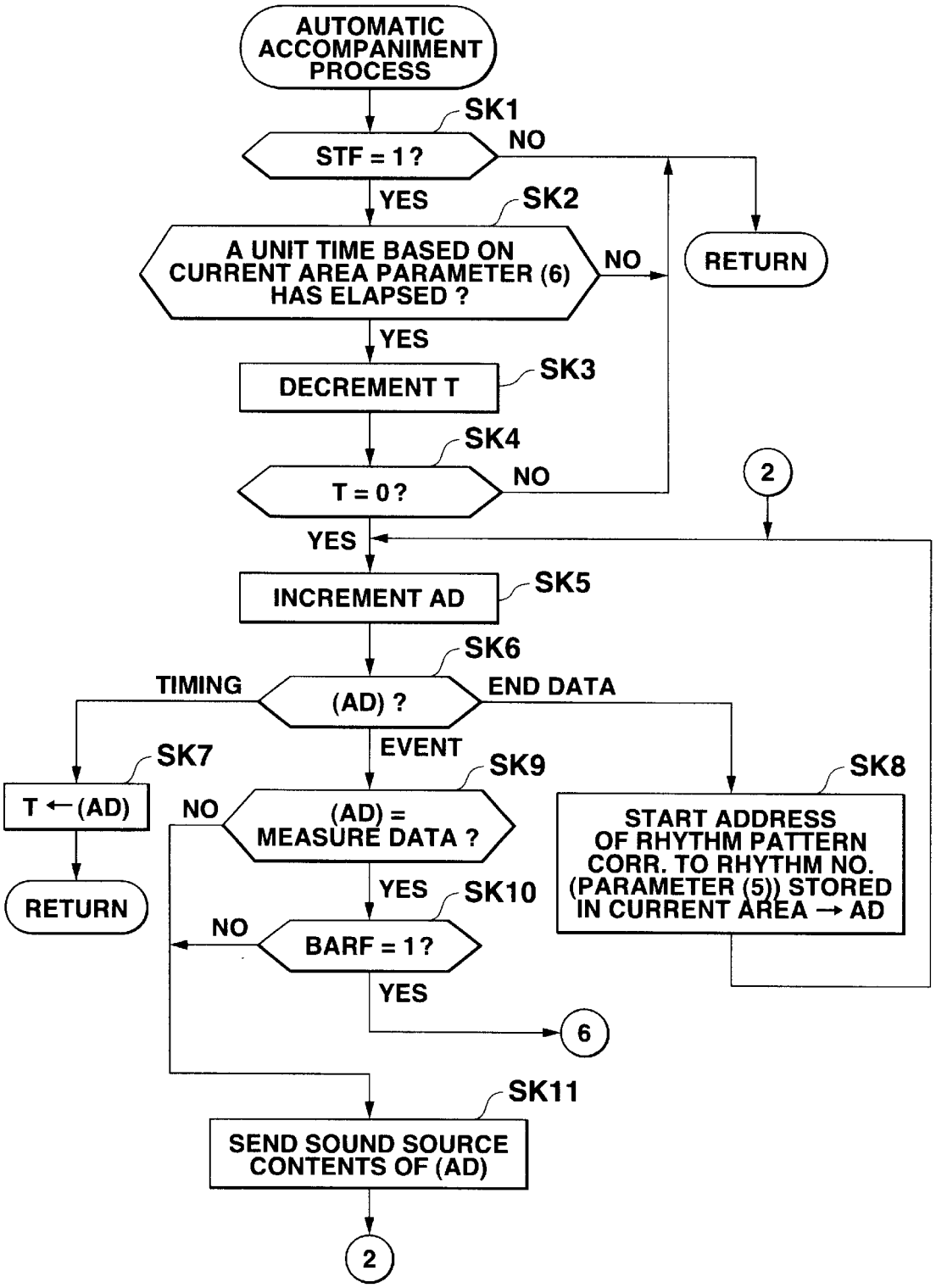
FIG. 14 is a flowchart of operation of a part of an automatic accompaniment process routine.
Figure 15:
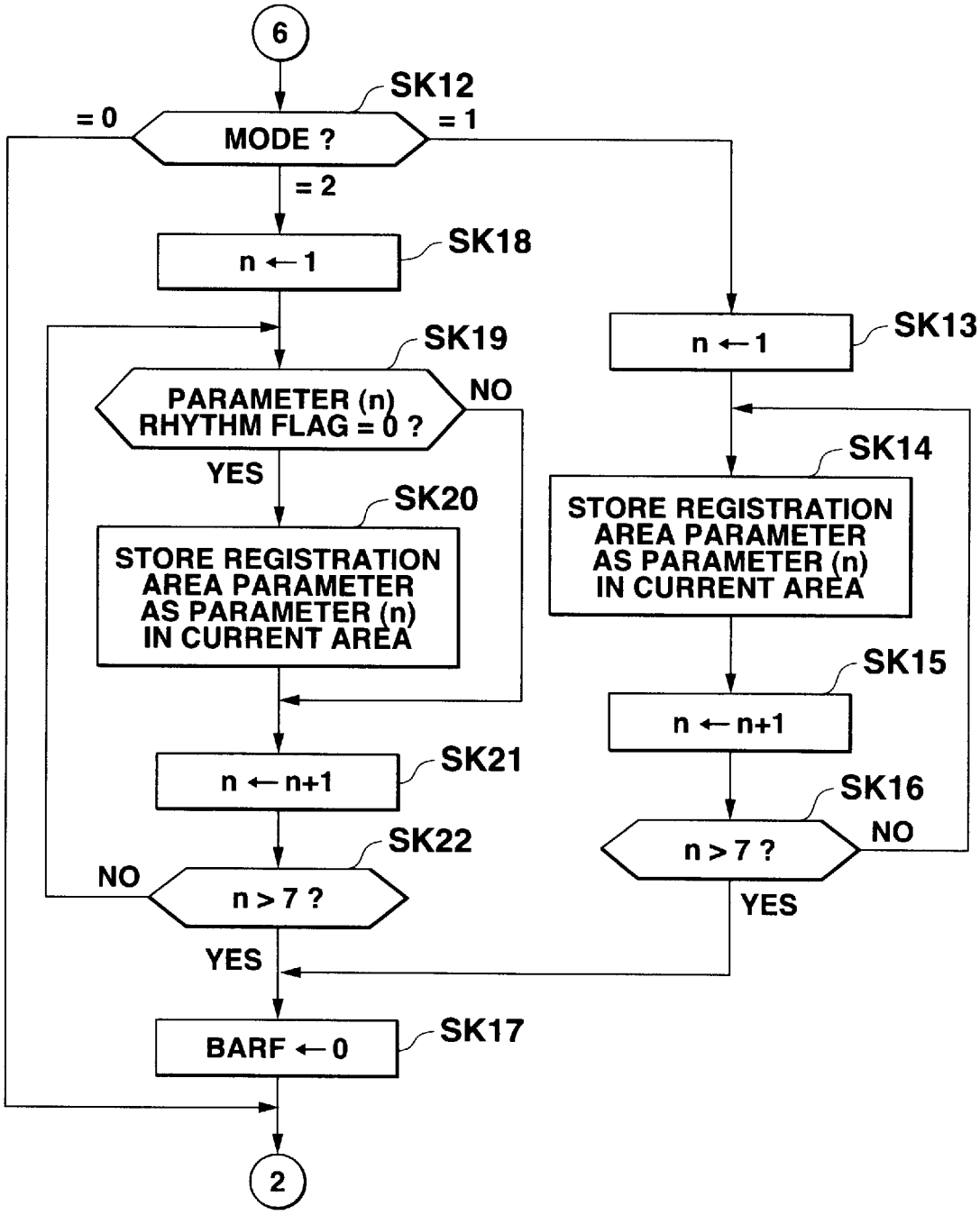
FIG. 15 is a flowchart of operation of the remaining part of an automatic accompaniment process routine.

Referring to FIGS. 14 and 15, operation of the automatic accompaniment process routine will be described next. When the automatic accompaniment process routine is executed through step SA4 (FIG. 3) of the main routine, CPU 4 passes its control to step SKi of FIG. 14 to determine whether start flag STF is "1". If start flag STF is "0", the automatic accompaniment is at stop. Thus, a result of the determination becomes "NO" and the routine is then terminated.

If CPU 4 is instructed to start the automatic accompaniment in the start/stop switch process routine and start flag STF is set to "1", the result of the determination becomes "YES". The control then passes to step SK2 to determine whether a unit time corresponding to a tempo value stored as a parameter (6) in the current area CE of RAM 6 has elapsed. That is, CPU 4 generates a tempo clock corresponding to a tempo value in a timer interrupt process (not shown), and determines whether a (unit) time corresponding to one cycle of the tempo clock has elapsed.

If it has not, a result of the determination becomes "NO" and the routine is then terminated temporarily. When the unit time has elapsed, the result of the determination becomes "YES". The control then passes to step SK3 to decrement timing data in register T stored in step SE5 (FIG. 8) when CPU 4 is instructed to start the automatic accompaniment in the start/step switch process routine.

Then, in step SK4 CPU 4 determines whether the decremented value of the register T is "0", or whether it has reached a sound generation timing. If it has not, the result of the determination becomes "NO" and the routine is temporarily terminated. When the sound generation timing has been reached, the result of the determination becomes "YES".

Then, step SK5 increments a read address stored in register AD to advance reading a rhythm pattern concerned Then, step SK6 and subsequent steps perform processes that correspond to data read out from the rhythm pattern in accordance with the incremented read address; that is, "timing data", "END data" and "event data or measure data", which will be described next.

(4-a) In the case of Timing Data

When the data read out from the rhythm pattern is timing data, the control passes to step SK7 to store the timing data in register T and to terminate the routine temporarily.

(4-b) In the Case of END Data

When the read data is END data indicative of the end of the pattern, the control passes to step SK8 to reset in register AD a start address of a rhythm pattern corresponding to a rhythm number stored as a parameter (5) in current area CE, and then to return the control to step SK5.

(4-c) In the Case of Event Data or Measure Data

When the read data is event data or measure data, the control passes to step SK9 to determine whether the data is measure data indicative of a start of a measure in the pattern. If it is not or it is event data, a result of the determination becomes "NO". Then, the control passes to step SK11 to send the event data to sound source 7 and to return the control to step SK5.

When the data is measure data, the result of the determination in step SK9 becomes "YES". Then, the control passes to step SK10 to determine whether flag BARF is set to "1". When flag BARF is "1", a registration is called in a state where the mode value has been set to "1" or "2". If flag BARF is not set to "1", the result of the determination becomes "NO". Thus, the control passes to step SK11 to send the measure data to sound source 7 and returns to step SK5. When flag BARF is set to "1", the result of the determination becomes "YES". Then, the control passes to step SK12 of FIG. 15. In step SK12 and subsequent steps, processes corresponding to respective mode values MODE are performed, which will be described as follows.

(4-c-1) When Mode Value MODE is "0"

In this case, all parameters (1)–(7) are read out from registration area RE to current area CE immediately in response to an on operation of registration call switch RCS irrespective of advancement of the automatic accompaniment. Thus, no other processes are performed in this routine and the control returns to step SK5 of FIG. 14.

(4-c-2) When Mode Value MODE is "1"

When mode value MODE is set to "1", the control passes to step SK13 to store an initial value "1" in register n. Then, step SK14 reads out parameter (n) in registration area RE corresponding to the value in register n and stores it as parameter (n) in the current area CE. Then, step SK15 increments the value in register n. Then, step SK16 determines whether the incremented value in register n has exceeded "7", or whether the registration call has been completed.

When the registration call is in progress, a result of the determination in step SK16 becomes "NO" and steps SK4 and SK5 are iterated When the registration call has been completed, the result of the determination in step SK16 becomes "YES". Then, the control passes to step SK17 to reset flag BARF to "0" and returns to step SK5 of FIG. 14.

As described above, when mode value MODE has been set to "1", all parameters (1)–(7) are called from registration area RE to current area CE when the head of the next measure appears after registration call switch RCS is switched on.

(4-c-3) When Mode Value MODE is "2"

When mode value MODE is set to "2", the control passes to step SK18 to store an initial value "1" in register n. Then, step SK19 determines whether rhythm flag RF stored as a parameter (n) in registration area RE corresponding to register n is "1", or whether registration area RE parameter (n) is a rhythm parameter.

If it is, a result of the determination becomes "YES". Then, the control passes to step SK20 to read out registration area RE parameter (n) corresponding to the value in register n, and to store it as a parameter (n) in the current area CE. If the data is a timbre parameter, the result of the determination becomes "NO". Then, the control passes to step SK21 to increment the value in register n. Then, step SK22 determines whether the incremented value in the register n has exceeded "7", or whether the registration call has been completed.

When the registration call is in progress, a result of the determination becomes "NO" and steps SK19–SK21 are iterated. When the registration call is completed, the result of the determination becomes "YES". Then, the control passes to step SK17 to reset flag BARF to "0", and returns to step SK5 of FIG. 14.

As described above, when mode value MODE is set to "2", only the rhythm parameter is called from registration area RE to current area CE at a timing when the head of the next measure appears after registration call switch RCS is switched on.

As described above, according to this embodiment when mode value MODE is set to "0" by mode select switch MSS and registration call switch RCS is switched on, all the parameters (1)–(7) are immediately called from registration area RE to current area CE irrespective of whether the automatic accompaniment is in progress. Thus, the parameters can be changed immediately.

When mode value MODE is set to "1" by mode select switch MSS and registration call switch RCS is switched on during automatic accompaniment, all the parameters (1)–(7) are called from registration area RE to the current area CE at a timing when the head of the next measure appears. Thus, a trouble in which a type of rhythm under accompaniment is abruptly changed to another is avoided, and the parameters are changed without giving a feeling of musical disorder.

When mode value MODE is set to "2" by mode select switch MSS and then registration call switch RCS is switched on, only the timbre parameters are immediately called among all the parameters (1)–(7) from registration area RE to current area CE irrespective of whether the automatic accompaniment is in progress. When registration call switch RCS is switched on during automatic accompaniment, only the rhythm parameters are called among all the parameters (1)–(7) from registration area RE to the current area CE at a timing when the head of the next measure appears.

Thus, parameters that will cause no feeling of musical disorder even when switched instantaneously to others can be changed immediately to others. Parameters that will cause a feeling of musical disorder when switched abruptly can be changed without causing any feeling of musical disorder, using the inventive method.

While in the embodiment the rhythm parameters under the automatic accompaniment are illustrated as being changed at a timing when the head of the next measure appears, the timing of changing the parameters is not limited to this example. Any timing that will cause no feeling of musical disorder may be specified freely by the user beforehand.

In addition to changing the parameters at a timing that causes no feeling of musical disorder as in the present embodiment, parameters about sound effects may be changed to others in response to call of a registration in a so-called cross-fading manner in which an effect to be added is faded in while the old effect is being faded out. This enables a type of effect to be changed without causing any feeling of musical disorder.

Various changes and modifications would be possible to those skilled in the art without departing from the spirit and scope of the invention defined in the attached claims.

What is claimed is:

1. A registration apparatus for an electronic musical instrument, comprising:

a first memory having stored a plurality of different parameters specifying a type of musical sound generation and a type of accompaniment;

a second memory;

registration means for reading out from the first memory a plurality of different parameters specifying a type of musical sound generation and a type of accompaniment from the first memory in accordance with an instruction of registration and for registering in the second memory the read-out plurality of different parameters specifying a type of musical sound generation and a type of accompaniment;

automatic accompaniment means for reading out parameters that specify a type of accompaniment from among the plurality of different parameters stored in the first memory and for performing a corresponding automatic accompaniment;

call type specifying means for specifying one of a first and a second call type;

first registration transfer means, responsive to the call type specifying means specifying the first call type, for immediately transferring to the first memory the plurality of different parameters registered in the second memory irrespective of whether the accompaniment performed by the automatic accompaniment means is in progress; and second registration transfer means, responsive to the call type specifying means specifying the second call type during the accompaniment performed by the automatic accompaniment means, for transferring to the first memory the plurality of different parameters registered in the second memory when the accompaniment reaches a predetermined timing.

2. The registration apparatus according to claim 1, wherein the call type specifying means is further capable of specifying a third call type, and further comprising third registration call means, responsive to the call type specifying means specifying the third call type, for immediately transferring to the first memory the parameters that specify the type of musical sound generation from among the plurality of different parameters registered in the second memory irrespective of whether the accompaniment is in progress, and for transferring to the first memory the parameters that specify the type of accompaniment from the plurality of different parameters registered in the second memory when the accompaniment reaches a predetermined timing.

3. A registration apparatus for an electronic musical instrument, comprising:

a first memory having stored a plurality of different parameters specifying a type of musical sound generation and a type of accompaniment;

a second memory;

registration means for reading out from the first memory a plurality of different parameters specifying a type of musical sound generation and a type of accompaniment from the first memory in accordance with an instruction of registration and for registering in the second memory the read-out plurality of different parameters specifying a type of musical sound generation and a type of accompaniment;

automatic accompaniment means for reading out parameters that specify a type of accompaniment from among the plurality of different parameters stored in the first memory and for performing a corresponding automatic accompaniment;

call type specifying means for specifying one of a first and a second call type;

first registration transfer means, responsive to the call type specifying means specifying the first call type, for immediately transferring to the first memory the plurality of different parameters registered in the second memory irrespective of whether the accompaniment performed by the automatic accompaniment means is in progress; and second registration call means, responsive to the call type specifying means specifying the second call type, for immediately selecting the parameters that specify the type of musical sound generation from among the plurality of different parameters registered in the second memory and for transferring the selected parameters that specify the type of musical sound generation to the first memory irrespective of whether the accompaniment performed by the automatic accompaniment means is in progress, and for selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

4. A registration apparatus for an electronic musical instrument, comprising:

a first memory having stored a plurality of different parameters specifying a type of musical sound generation and a type of accompaniment;

a second memory;

registration means for reading out from the first memory a plurality of different parameters specifying a type of musical sound generation and a type of accompaniment from the first memory in accordance with an instruction of registration and for registering in the second memory the read-out plurality of different parameters specifying a type of musical sound generation and a type of accompaniment;

automatic accompaniment means for reading out parameters that specify a type of accompaniment from among the plurality of different parameters stored in the first memory and for performing a corresponding automatic accompaniment;

call type specifying means for specifying one of a first and a second call type;

first registration transfer means, responsive to the call type specifying means specifying the first call type during the accompaniment performed by the automatic accompaniment means, for transferring to the first memory the plurality of different parameters registered in the second memory when the accompaniment reaches a predetermined timing; and second registration call means, responsive to the call type specifying means specifying the second call type, for immediately selecting the parameters that specify the type of musical sound generation from among the plurality of different parameters registered in the second memory and for transferring the selected parameters that specify the type of musical sound generation to the first memory irrespective of whether the accompaniment performed by the automatic accompaniment means is in progress, and for selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

5. A registration method for an electronic musical instrument, comprising the steps of:

storing a plurality of different parameters specifying a type of musical sound generation and a type of accompaniment;

reading out from the first memory a plurality of different parameters specifying a type of musical sound generation and a type of accompaniment from the first memory in accordance with an instruction of registration and for registering in a second memory the read-out plurality of different parameters specifying a type of musical sound generation and a type of accompaniment;

reading out parameters that specify a type of accompaniment from among the plurality of different parameters stored in the first memory and for performing a corresponding automatic accompaniment;

specifying one of a first and a second call type;

responsive to the specifying step specifying the first call type, immediately transferring to the first memory the plurality of different parameters registered in the second memory irrespective of whether the accompaniment performed by the automatic accompaniment means is in progress; and responsive to the specifying step specifying the second call type during the accompaniment, transferring to the first memory the plurality of different parameters registered in the second memory when the accompaniment reaches a predetermined timing.

6. The registration method according to claim 5, wherein the specifying step further comprises specifying a third call type, and further comprising the step of responsive to the specifying step specifying the third call type, immediately transferring to the first memory the parameters that specify the type of musical sound generation from among the plurality of different parameters registered in the second memory irrespective of whether the accompaniment is in progress, and transferring to the first memory the parameters that specify the type of accompaniment from the plurality of different parameters registered in the second memory when the accompaniment reaches a predetermined timing.

7. A registration method for an electronic musical instrument, comprising the steps of:

storing a plurality of different parameters specifying a type of musical sound generation and a type of accompaniment;

reading out from the first memory a plurality of different parameters specifying a type of musical sound generation and a type of accompaniment from the first memory in accordance with an instruction of registration and registering in a second memory the read-out plurality of different parameters specifying a type of musical sound generation and a type of accompaniment;

reading out parameters that specify a type of accompaniment from among the plurality of different parameters stored in the first memory and for performing a corresponding automatic accompaniment;

specifying one of a first and a second call type;

responsive to the specifying step specifying the first call type, immediately transferring to the first memory the plurality of different parameters registered in the second memory irrespective of whether the accompaniment is in progress; and responsive to the specifying step specifying the second call type, immediately selecting the parameters that specify the type of musical sound generation from among the plurality of different parameters registered in the second memory and transferring the selected parameters that specify the type of musical sound generation to the first memory irrespective of whether the accompaniment is in progress, and selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

8. A registration method for an electronic musical instrument, comprising the steps of:

storing a plurality of different parameters specifying a type of musical sound generation and a type of accompaniment;

reading out from the first memory a plurality of different parameters specifying a type of musical sound generation and a type of accompaniment from the first memory in accordance with an instruction of registration and registering in a second memory the read-out plurality of different parameters specifying a type of musical sound generation and a type of accompaniment;

reading out parameters that specify a type of accompaniment from among the plurality of different parameters stored in the first memory and for performing a corresponding automatic accompaniment;

call type specifying means for specifying one of a first and a second call type;

responsive to the specifying step specifying the first call type during the accompaniment, transferring to the first memory the plurality of different parameters registered in the second memory when the accompaniment reaches a predetermined timing; and responsive to the specifying step specifying the second call type, immediately selecting the parameters that specify the type of musical sound generation from among the plurality of different parameters registered in the second memory and transferring the selected parameters that specify the type of musical sound generation to the first memory irrespective of whether the accompaniment is in progress, and selecting the parameters that specify the type of accompaniment from among the plurality of different parameters registered in the second memory and for transferring the selected parameters that specify the type of accompaniment to the first memory when the accompaniment that is in progress, if any, reaches a predetermined timing.

* * * * *